US005294317A

United States Patent [19]

Saito et al.

[11] Patent Number: 5,294,317

[45] Date of Patent: Mar. 15, 1994

[54] OXYGEN GENERATING ELECTRODE

[75] Inventors: Hiroaki Saito, Chiba; Yukio Kawashima, Tokyo; Kazuhide Ohe, Chiba, all of Japan

[73] Assignee: TDK Corporation, Tokyo, Japan

[21] Appl. No.: 28,805

[22] Filed: Mar. 10, 1993

[30] Foreign Application Priority Data

Mar. 11, 1992 [JP] Japan ..... 4-87621
Apr. 14, 1992 [JP] Japan ..... 4-120029

[51] Int. Cl.[5] ..... C25B 11/00

[52] U.S. Cl. ..... 204/290 F; 427/126.3; 427/126.5; 429/44

[58] Field of Search ..... 204/290 F, 416, 418, 204/419; 427/126.3, 126.5, 126.1, 125, 333, 383.1, 383.5; 429/44

[56] References Cited

U.S. PATENT DOCUMENTS 4,481,097 11/1984 Asano et al. ..... 204/290 F
4,502,936 3/1985 Hayfield ..... 204/290 F
4,707,229 11/1987 Dempsey et al. ..... 204/290 F
5,156,726 10/1992 Nakada et al. ..... 204/290 F

FOREIGN PATENT DOCUMENTS 46-21884 6/1971 Japan .
48-3954 2/1973 Japan .
50-11330 4/1975 Japan .
56-123388 9/1981 Japan .
56-123389 9/1981 Japan .
57-73193 5/1982 Japan .
57-116786 7/1982 Japan .
60-21232 5/1985 Japan .
60-22075 5/1985 Japan .
60-184690 9/1985 Japan .
60-184691 9/1985 Japan .
63-235493 9/1988 Japan .
1-301876 12/1989 Japan .
2-61083 3/1990 Japan .
2-190491 7/1990 Japan .
2-200790 8/1990 Japan .
2-294494 12/1990 Japan .
3-55558 8/1991 Japan .
3-193889 8/1991 Japan .

*Primary Examiner*—John Niebling
*Assistant Examiner*—Bruce F. Bell
*Attorney, Agent, or Firm*—Oblon, Spivak, McClelland, Maier & Neustadt

[57] ABSTRACT

An oxygen generating electrode has on a conductive substrate a first layer of metallic platinum and tantalum oxide containing 80–99 mol% of Ta and 20–1 mol% of Pt, a second layer of iridium oxide and tantalum oxide containing 80–99.9 mol% of Ir and 20–0.1 mol% of Ta, and preferably a third layer of iridium oxide and tantalum oxide containing 40–79.9 mol% of Ir and 60–20.1 mol% of Ta. In another embodiment, the first layer consists of iridium oxide and tantalum oxide and contains 14–8.4 mol% of Ir and 86–91.6 mol% of Ta. The electrode, when used as an anode in electrolysis with concomitant oxygen generation, can be used for an extended period at a low bath voltage. It is adapted for electrolysis at a high current density of more than 100 $A/cm^2$ since it maintains mechanical strength and has a long effective life. It experiences a minimal change of oxygen overvoltage with time.

12 Claims, No Drawings

OXYGEN GENERATING ELECTRODE

BACKGROUND OF THE INVENTION

1. Field of the Invention

This invention relates to a novel oxygen generating electrode. More particularly, it relates to an oxygen generating electrode suitable for use as an anode in electrolysis of a desired aqueous solution for generating oxygen at the anode and featuring improved durability and low oxygen overvoltage.

2. Prior Art

Metal electrodes in the form of conductive substrates of metallic titanium having coatings of platinum group metals or oxides thereof were conventionally used in various areas of the electrolysis industry. For example, electrodes in the form of titanium substrate coated with ruthenium and titanium oxides or ruthenium and tin oxides are known as effective anodes for generating oxygen through salt electrolysis as disclosed in Japanese Patent Publication (JP-B) Nos. 21884/1971, 3954/1973 and 11330/1975.

In the electrolysis industry, some electrolysis processes are accompanied by chlorine generation as in the case of salt electrolysis and some are accompanied by oxygen generation as in the case of acid, alkali or salt recovery, collection of metals such as copper and zinc, electrodeposition, and cathodic corrosion prevention.

If conventional electrodes for normal use in chlorine generating situations such as the above-mentioned electrodes in the form of titanium substrates coated with ruthenium and titanium oxides or ruthenium and tin oxides were used in electrolysis with concomitant oxygen generation, the electrodes could be corroded and cease to be effective within a short time. Then those electrodes specially designed for oxygen generation were used in such applications. Although iridium oxide-platinum system electrodes, iridium oxide-tin oxide system electrodes, and platinum-coated titanium electrodes are known, lead system electrodes and soluble zinc electrodes are most commonly utilized.

However, these known electrodes suffer from several troubles in particular applications and are thus not fully satisfactory. In the case of zinc electrodeposition, for example, soluble zinc anodes are so quickly dissolved that the electrode distance must be frequently adjusted. Insoluble lead anodes would produce defective deposits due to the influence of lead introduced into the electrolyte solution. Platinum-coated titanium electrodes cannot be applied to high-speed zinc plating with a high current density of at least 100 A/dm$^2$ because of substantial consumption.

Therefore, it is one of important tasks in the electrode manufacturing technology to develop an electrode for use in electrolysis with concomitant oxygen generation which is universally applicable to a wide variety of applications without any inconvenience.

In general, when electrolysis with concomitant oxygen generation is carried out using a titanium base electrode having a coating layer as the anode, a titanium oxide layer is formed between the base and the coating layer and the anode potential gradually increases, often resulting in stripping of the coating layer and passivation of the anode. In order to prevent formation of intervening titanium oxide, passivation of the anode, and increase of electric resistance, intermediate layers are previously formed from various metal oxides as disclosed in JP-B 21232/1985, JP-B 22075/1985, Japanese Patent Application Kokai (JP-A) Nos. 116786/1982 and 184690/1985. These intermediate layers, however, are generally less conductive than the coating layers and thus, they are not so effective as expected especially in electrolysis at a high current density.

Also, JP-A 184691/1985 discloses an intermediate layer having platinum dispersed in base metal oxide and JP-A 73193/1982 discloses an intermediate layer of valve metal oxide and noble metal. The former intermediate layer was less effective since platinum is less corrosion resistant by itself. The intermediate layer having valve metal oxide mixed was difficult to achieve the desired effect since the type and amount of valve metal were naturally limited.

Also known are electrodes having a lead dioxide coating formed on a conductive metal substrate via an intermediate layer of iridium oxide and tantalum oxide (see JP-A 123388/1981 and 123389/1981). This intermediate layer is effective only for improving the adhesion between the metal substrate and the lead dioxide coating and preventing any corrosion by pinholes or defects, but not fully effective in suppressing formation of titanium oxide when used in electrolysis with concomitant oxygen generation. Additionally contamination of the electrolytic solution with lead is unavoidable.

Other known electrodes are iridium oxide/tantalum oxide coated electrodes including one having on a conductive metal substrate an intermediate layer of iridium oxide and tantalum oxide and an overcoat layer of iridium oxide (see JP-A 235493/1988) and one of the same arrangement, but having increased contents of iridium oxide in the overcoat layer (see JP-A 61083/1990 and 193889/1991). More particularly, in JP-A 61083/1990, the undercoat layer contains 2.6 to 8.1 mol% of Ir and the overcoat layer contains 17.6 to 66.7 mol% of Ir while there is shown a comparative example having an undercoat layer with 16.7 mol% Ir. In JP-A 193889/1991, the undercoat layer contains 40 to 79 mol% of Ir (30 mol% in a comparative example) and the overcoat layer contains 80 to 99.9 mol% of Ir. Therefore known undercoat layers which are Ir poorer than the overcoat layer have Ir contents of up to 8.1 mol% or at least 16.7 mol%. Power losses occur since the iridium oxide in the overcoat layer has a higher oxygen overvoltage than the intermediate layer of iridium oxide and tantalum oxide. These electrodes are unsatisfactory in change with time of oxygen overvoltage after electrolysis and short in lifetime. A bond strength lowering at the end of electrolysis is also a problem.

JP-B 55558/1991 discloses a single iridium oxide-tantalum oxide coating with an Ir content of 19.8 to 39.6 mol%. This electrode is also unsatisfactory in oxygen overvoltage, lifetime and bond strength.

Electrodes having a low oxygen overvoltage are also known. For example, JP-A 301876/1989 discloses an electrode having a coating of iridium oxide, tantalum oxide and platinum. This electrode is expensive since iridium and platinum must be used in the undercoat layer. It is less advantageous in lifetime and degradation with time than the iridium oxide/tantalum oxide coated electrodes. A bond strength lowering at the end of electrolysis is also a problem.

Also known are electrodes having a dispersion coated intermediate layer of platinum and iridium oxide or base metal oxide and an overcoat layer of iridium oxide or platinum and valve metal oxide (JP-A 190491/1990, 200790/1990, and 150091/1984). These electrodes, however, are not so long lasting as expected and the intermediate layer is costly.

JP-A 294494/1990 discloses an electrode having an intermediate layer of platinum or iridium oxide and valve metal oxide and an overcoat layer of platinum or lead dioxide, which has a high oxygen overvoltage and a relatively short lifetime.

SUMMARY OF THE INVENTION

Therefore, a primary object of the present invention is to provide a novel and improved electrode comprising an iridium oxide base coating on a conductive substrate, typically titanium, which is effective for suppressing formation of titanium oxide at the interface therebetween, performs well over a long time in electrolysis with concomitant oxygen generation, and shows a low anodic potential in electrolysis at a high current density.

We continued investigation efforts to develop oxygen generating electrodes having improved durability and an increased service life. By adding an adequate proportion of platinum metal to a tantalum oxide coating layer on a conductive substrate such as titanium, we have succeeded in reducing the electric resistance and suppressing consumption and degradation of the electrode. And we have found that by providing an iridium oxide/tantalum oxide layer on the platinum-added intermediate coating layer, any deterioration of the intermediate coating layer can be suppressed without an increase of electric resistance. The present invention in the first form is predicated on this finding.

In the first form, the present invention provides an oxygen generating electrode comprising on a conductive substrate a first layer of metallic platinum and tantalum oxide containing 80 to 99 mol% of tantalum and 20 to 1 mol% of platinum calculated as metals. On the first layer is provided a second layer of iridium oxide and tantalum oxide containing 80 to 99.9 mol% of iridium and 20 to 0.1 mol% of tantalum calculated as metals.

Preferably, on the second layer is provided a third layer of iridium oxide and tantalum oxide containing 40 to 79.9 mol% of iridium and 60 to 20.1 mol% of tantalum calculated as metals. Also preferably more than one unit consisting of the second and third layers is repeatedly stacked on the substrate.

The electrode in the first form is prepared by applying a solution containing a platinum compound and a tantalum compound to the substrate and heat treating the coating in an oxidizing atmosphere for forming the first layer, and applying a solution containing an iridium compound and a tantalum compound thereto and heat treating the coating in an oxidizing atmosphere for forming the second layer.

The third layer is formed by applying a solution containing an iridium compound and a tantalum compound to the second layer and heat treating the coating in an oxidizing atmosphere. The steps of forming the second and third layers may be repeated for alternately stacking the second and third layers.

We have also found that the electrode can be reduced in electric resistance and suppressed in consumption by controlling the amount of Ir in the iridium oxide-tantalum oxide undercoat layer on the titanium substrate and that by providing an iridium oxide/tantalum oxide layer having a specific iridium content on the undercoat layer, any deterioration of the undercoat layer can be suppressed without an increase of electric resistance. The present invention in the second form is predicated on this finding.

The second form of the present invention is an oxygen generating electrode comprising on a conductive substrate a first layer of iridium oxide and tantalum oxide containing 14 to 8.4 mol% of iridium and 86 to 91.6 mol% of tantalum calculated as metals. On the first layer is formed a second layer of iridium oxide and tantalum oxide containing 80 to 99.9 mol% of iridium and 20 to 0.1 mol% of tantalum calculated as metals.

Preferably on the second layer is formed a third layer of iridium oxide and tantalum oxide containing 40 to 79.9 mol% of iridium and 60 to 20.1 mol% of tantalum calculated as metals. More than one unit consisting of the second and third layers may be repeatedly stacked on the substrate.

The electrode in the second form is prepared by the same method as in the first form except that the coating solution for the first layer is a solution containing an iridium compound and a tantalum compound.

DESCRIPTION OF THE PREFERRED EMBODIMENTS

First Embodiment

The electroconductive substrate used in the electrode of the invention is often made of a valve metal such as titanium, tantalum, zirconium and niobium or an alloy of two or more valve metals.

The electrode of the invention includes an undercoat or first layer on the substrate. The first layer is formed from metallic platinum and tantalum oxide. The first layer contains platinum and tantalum such that tantalum ranges from 80 to 99 mol% and platinum ranges from 20 to 1 mol%, calculated as metals. Within this range, better results are obtained in a region having a lower proportion of platinum. The undercoat or first layer containing an excess of platinum beyond the range increase the cost and is less effective in increasing the bond strength between the substrate and the overcoat or second layer whereas the first layer containing smaller proportions of platinum below the range has a reduced film electric resistance and hence an increased oxygen overvoltage.

For fully accomplishing the desired effect, the content of metallic platinum in the first layer is adjusted to 0.1 to 3 mg/cm$^2$. It is to be noted that platinum is contained in the layer in a spill-over state and no peak or a broad peak appears in X-ray diffractometry.

Also included in the electrode of the invention is an overcoat or second layer on the undercoat or first layer. The second layer is formed of iridium oxide and tantalum oxide and contains 80 to 99.9 mol% of iridium and 20 to 0.1 mol% of tantalum calculated as metals. Within this range, better results are obtained in a region having a larger proportion of iridium oxide. The second layer containing an excess of iridium oxide beyond the range is less effective because of reduced bond strength whereas the second layer containing smaller proportions of iridium oxide below the range leads to an increased oxygen overvoltage.

In the second layer, the content of iridium oxide is preferably adjusted to 0.01 to 7 mg/cm$^2$ calculated as metal. With the second layer containing less than 0.01 mg/cm$^2$ of iridium, the electrode would be considerably consumed during electrolysis and hence, less durable. In excess of 7 mg/cm$^2$ of iridium, bond strength would be lower.

In the first embodiment, the electrode is prepared by first applying a first solution containing a platinum compound and a tantalum compound to the conductive substrate and heat treating the coating in an oxidizing atmosphere for forming the first layer of metallic platinum and tantalum oxide containing 80 to 99 mol% of tantalum and 20 to 1 mol% of platinum calculated as metals. The first coating solution used herein contains a platinum compound which converts into metallic platinum upon pyrolysis, for example, such as chloroplatinic acid ($H_2PtCl_6 \cdot 6H_2O$) and a tantalum compound which converts into tantalum oxide upon pyrolysis, for example, tantalum halides such as tantalum chloride and tantalum alkoxides such as tantalum ethoxide. The solution is obtained by dissolving appropriate proportions of the platinum and tantalum compounds in a suitable solvent. Preferred solvents are alcohols such as butanol.

After the first solution is coated on the substrate and dried, heat treatment is carried out by firing in an oxidizing atmosphere, preferably in the presence of oxygen, more preferably at an oxygen partial pressure of at least 0.05 atm. and a temperature of 400° to 550° C. This coating and heat treating procedure is repeated until the desired metal loading is reached.

In this way, the undercoat or first layer of the desired metal loading is obtained. The process further includes the steps of applying a second solution containing an iridium compound and a tantalum compound to the first layer and heat treating the coating in an oxidizing atmosphere for forming the second layer of iridium oxide and tantalum oxide containing 80 to 99.9 mol% of iridium and 20 to 0.1 mol% of tantalum calculated as metals. The second coating solution used herein contains an iridium compound which converts into iridium oxide upon pyrolysis, for example, such as chloroiridic acid ($H_2IrCl_6 \cdot 6H_2O$) and iridium chloride and a tantalum compound which converts into tantalum oxide upon pyrolysis, for example, tantalum halides such as tantalum chloride and tantalum alkoxides such as tantalum ethoxide. The solution is obtained by dissolving appropriate proportions of the iridium and tantalum compounds in a suitable solvent.

After the second solution is coated on the first layer and dried, heat treatment is carried out by firing in an oxidizing atmosphere, preferably in the presence of oxygen and at a temperature of 400° to 550° C. This coating and heat treating procedure is repeated until the desired metal loading is reached. In this way, the second layer having the desired contents of iridium oxide and tantalum oxide is formed on the first layer, yielding the electrode of the present invention.

If the heat treatment for forming these coating layers, that is, the first and second layers is not effected in an oxidizing atmosphere, the coatings ar insufficiently oxidized so that the metals are free in the coatings, resulting in a less durable electrode.

In a preferred embodiment, the electrode further includes a third layer on the second layer. The third layer is formed of iridium oxide and tantalum oxide and contains 40 to 79.9 mol% of iridium and 60 to 20.1 mol% of tantalum calculated as metals. The provision of the third layer improves the bond strength and mechanical strength of the electrode during electrolysis. An excess of iridium oxide beyond the range in the third layer reduces the mechanical strength during electrolysis whereas smaller proportions of iridium oxide below the range lead to an increased oxygen overvoltage. In the third layer, the content of iridium oxide is preferably adjusted to 0.01 to 7 mg/cm$^2$ calculated as metal. Bond strength would be low outside this range. The third layer can be formed by the same procedure as the second layer.

In a further preferred embodiment, the second and third layers may be alternately stacked on the first layer in more than one repetition. Better results are obtained when the third layer is the uppermost layer. Provided that a stacking unit consists of a second layer and a third layer, more than one unit is preferably provided and often 2 to 10 units are provided. By stacking the units of second and third layers, the electrode is improved in mechanical strength during electrolysis. It is to be noted that in this embodiment wherein the units of second and third layers are stacked, the overall metal loading should preferably be equal to the above-mentioned metal loading of each of the second and third layers.

Any of the first, second and third layers may additionally contain a platinum group metal such as ruthenium, palladium, rhodium and osmium, a platinum group metal oxide, an oxide of a valve metal such as titanium, niobium and zirconium, or tin oxide in an amount of up to 10% by weight of each layer.

Second Embodiment

The electroconductive substrate used in the electrode of the invention is often made of a valve metal such as titanium, tantalum, zirconium and niobium or an alloy of two or more valve metals.

The electrode of the invention includes an undercoat or first layer on the substrate. The first layer is formed from iridium oxide and tantalum oxide. The first layer contains iridium and tantalum such that tantalum ranges from 86 to 91.6 mol% and iridum ranges from 14 to 8.4 mol%, calculated as metals. Undercoat or first layers containing more than 14 mol% or less than 8.4 mol% of iridium have a reduced film electric resistance and hence an increased oxygen overvoltage and thus tend to degrade with time. Iridium in excess of 14 mol% also reduces the useful life of the electrode.

For fully accomplishing the desired effect, the content of iridium in the first layer is adjusted to 0.1 to 3 mg/cm$^2$ calculated as metallic iridium.

Also included in the electrode of the invention is an overcoat or second layer on the undercoat or first layer. The second layer is formed of iridium oxide and tantalum oxide and contains 80 to 99.9 mol% of iridium and 20 to 0.1 mol% of tantalum calculated as metals. Within this range, better results are obtained in a region having a larger proportion of iridium oxide. The second layer containing more than 99.9 mol% of iridium is less effective because of reduced bond strength whereas the second layer containing less than 80 mol% of iridium leads to an increased oxygen overvoltage.

In the second layer, the content of iridium oxide is preferably adjusted to 0.01 to 7 mg/cm2 calculated as metallic iridium. With the second layer containing less than 0.01 mg/cm$^2$ of iridium, the electrode would be considerably consumed during electrolysis and hence, less durable. In excess of 7 mg/cm$^2$ of iridium, bond strength would be lower.

In the second embodiment, the electrode is prepared by first applying a first solution containing an iridium compound and a tantalum compound to the conductive substrate and heat treating the coating in an oxidizing atmosphere for forming the first layer of iridium oxide and tantalum oxide containing 86 to 91.6 mol% of tantalum and 14 to 8.4 mol% of iridium calculated as metals. The first coating solution used herein contains an iridium compound which converts into iridium oxide upon pyrolysis, for example, such as chloroiridic acid ($H_2IrCl_6.6H_2O$) and iridium chloride and a tantalum compound which converts into tantalum oxide upon pyrolysis, for example, tantalum halides such as tantalum chloride and tantalum alkoxides such as tantalum ethoxide. The solution is obtained by dissolving appropriate proportions of the iridium and tantalum compounds in a suitable solvent. Preferred solvents are alcohols such as butanol.

After the first solution is coated on the substrate and dried, heat treatment is carried out by firing in an oxidizing atmosphere, preferably in the presence of oxygen, more preferably at an oxygen partial pressure of at least 0.05 atm. and a temperature of 400° to 550° C. This coating and heat treating procedure is repeated until the desired metal loading is reached.

In this way, the undercoat or first layer of the desired metal loading is obtained. The process further includes the steps of applying a second solution containing an iridium compound and a tantalum compound to the first layer and heat treating the coating in an oxidizing atmosphere for forming the second layer of iridium oxide and tantalum oxide containing 80 to 99.9 mol% of iridium and 20 to 0.1 mol% of tantalum calculated as metals. The second coating solution used herein contains an iridium compound which converts into iridium oxide upon pyrolysis as mentioned above and a tantalum compound which converts into tantalum oxide upon pyrolysis as mentioned above. The solution is obtained by dissolving appropriate proportions of the iridium and tantalum compounds in a suitable solvent.

After the second solution is coated on the first layer and dried, heat treatment is carried out by firing in an oxidizing atmosphere, preferably in the presence of oxygen and at a temperature of 400° to 550° C. This coating and heat treating procedure is repeated until the desired metal loading is reached. In this way, the second layer having the desired contents of iridium oxide and tantalum oxide is formed on the first layer, yielding the electrode of the present invention.

If the heat treatment for forming these coating layers, that is, the first and second layers is not effected in an oxidizing atmosphere, the coatings are insufficiently oxidized so that free metals are present in the coatings, resulting in a less durable electrode.

In a preferred embodiment, the electrode further includes a third layer on the second layer. The third layer is formed of iridium oxide and tantalum oxide and contains 40 to 79.9 mol% of iridium and 60 to 20.1 mol% of tantalum calculated as metals. The provision of the third layer improves the bond strength and mechanical strength of the electrode during electrolysis. More than 79.9 mol% of iridium in the third layer reduces the mechanical strength during electrolysis whereas less than 40 mol% of iridium leads to an increased oxygen overvoltage. In the third layer, the content of iridium oxide is preferably adjusted to 0.01 to 7 mg/cm$^2$ calculated as metallic iridium. Bond strength would be low outside this range. The third layer can be formed by the same procedure as the second layer.

In a further preferred embodiment, the second and third layers may be alternately stacked on the first layer in more than one repetition. Better results are obtained when the last one of the third layers is the uppermost layer. Provided that a stacking unit consists of a second layer and a third layer, more than one unit is preferably provided and often 2 to 10 units are provided. By stacking the units of second and third layers, the electrode is improved in mechanical strength during electrolysis. It is to be noted that in this embodiment wherein the units of second and third layers are stacked, the overall metal loading should preferably be equal to the above-mentioned metal loading of each of the second and third layers.

Any of the first, second and third layers may additionally contain a platinum group metal such as ruthenium, palladium, rhodium and osmium, a platinum group metal oxide, an oxide of a valve metal such as titanium, niobium and zirconium, or tin oxide in an amount of up to 10% by weight of each layer.

EXAMPLE

Examples of the present invention are given below by way of illustration and not by way of limitation.

Examples 1 to 3 are illustrative of the first embodiment.

EXAMPLE 1

There were formed stacking layers consisting of metallic platinum and tantalum oxide, iridium oxide and tantalum oxide, or metallic platinum, iridium oxide and tantalum oxide in a compositional ratio as shown in Table 1. More particularly, first layer-coating solutions having varying compositional ratios of iridium/platinum/tantalum were prepared by dissolving chloroplatinic acid ($H_2PtCl_6.6H_2O$), tantalum ethoxide ($Ta(OC_2H_5)_5$) and chloroiridic acid ($H_2IrCl_6.6H_2O$) in butanol in a concentration of 80 g/liter of metals. Second layer-coating solutions having varying compositional ratios of iridium/tantalum were prepared by dissolving chloroiridic acid ($H_2IrCl_6.6H_2O$) and tantalum ethoxide ($Ta(OC_2H_5)_5$) in butanol in a concentration of 80 g/liter of metals.

To a titanium substrate which was previously etched with hot oxalic acid, the first layer-coating solution was brush coated, dried and then baked by placing the structure in an electric oven where it was heated at 500° C. in an air stream. The coating, drying and baking procedure was repeated several times until the predetermined metal loading was reached. In this way, there were formed first layers consisting of metallic platinum and tantalum oxide (inventive sample Nos. 101–105 and comparative sample Nos. 114–117), iridium oxide (comparative sample No. 106, 112, 113), iridium oxide and tantalum oxide (comparative sample Nos. 107–110), and platinum, iridium oxide and tantalum oxide (comparative sample No. 111). The platinum-containing first layers had a platinum loading of 0.3 to 0.7 mg/cm$^2$ and the remaining first layers free of platinum had an equivalent or nearly equivalent metal loading.

To the first layer, the second layer-coating solution was brush coated, dried and then baked by placing the structure in an electric oven where it was heated at 500° C. in an air stream. The coating, drying and baking procedure was repeated several times until the predetermined metal loading was reached. There were formed the second layers consisting of iridium oxide and tantalum oxide. The second layers had an iridium loading of 1.3 to 1.7 mg/cm$^2$. The electrode samples were completed in this way.

Each of the electrodes was measured for oxygen overvoltage in accordance with a potential scanning method by immersing the electrode in a 1 mol/liter sulfuric acid aqueous solution at 30° C. and conducting electricity at a current density of 20 A/dm$^2$. The results are also shown in Table 1.

The lifetime of the electrode was measured in a 1 mol/liter sulfuric acid aqueous solution at 60° C. Using the electrode as an anode and a cathode of platinum, electrolysis was carried out at a current density of 200 A/dm$^2$. The lifetime is the time over which electrolysis could be continued. The electrodes were evaluated satisfactory (○) when the lifetime was longer than 2,000 hours, fair (Δ) when the lifetime was 1,000 to 2,000 hours, and rejected (×) when the lifetime was shorter than 1,000 hours.

In order to demonstrate how electrodes having first and second layers according to the invention were effective, the electrodes were tested for mechanical strength during electrolysis. The test method involved continuing the lifetime test for 1,000 hours, subjecting the electrode to a ultrasonic vibratory stripping test for 5 minutes, measuring the coating thickness before and after the vibratory stripping test by fluorescent X-ray analysis, and determining a weight loss. The stripping resistance was evaluated satisfactory (○) when the weight loss was less than 5%, fair (Δ) when the weight loss 5 to 10%, and rejected (×) when the weight loss was more than 10%.

The results are shown in Table 1.

TABLE 1

| | Undercoat Layer | | | Overcoat Layer | | Oxygen | Change with time | | Mechanical bond |
|---|---|---|---|---|---|---|---|---|---|
| | Iridium Oxide (mol %) | Platinum (mol %) | Tantalum Oxide (mol %) | Iridium Oxide (mol %) | Tantalum Oxide (mol %) | over-voltage (mV) | of oxygen over-voltage | Life time | strength (Ultrasonic weight loss) |
| Example | | | | | | | | | |
| 101 | — | 10 | 90 | 85 | 15 | 385 | ○ | ○ | ○ |
| 102 | — | 15 | 85 | 85 | 15 | 390 | ○ | ○ | ○ |
| 103 | — | 5 | 95 | 90 | 10 | 395 | ○ | ○ | ○ |
| 104 | — | 10 | 90 | 90 | 10 | 395 | ○ | ○ | ○ |
| 105 | — | 15 | 85 | 90 | 10 | 395 | ○ | ○ | ○ |
| Comparative Example | | | | | | | | | |
| 106 | 100 | — | — | — | — | 430 | Δ | Δ | Δ |
| 107 | 70 | — | 30 | — | — | 410 | Δ | Δ | Δ |
| 108 | 60 | — | 40 | — | — | 405 | Δ | Δ | Δ |
| 109 | 30 | — | 70 | — | — | 450 | X | X | X |
| 110 | 30 | — | 70 | 70 | 30 | 430 | Δ | Δ | ○ |
| 111 | 60 | 10 | 30 | 30 | 70 | 430 | Δ | Δ | ○ |
| 112 | 100 | — | — | 70 | 30 | 420 | Δ | Δ | ○ |
| 113 | 100 | — | — | 85 | 15 | 420 | Δ | Δ | ○ |
| 114 | — | 0.5 | 99.5 | 85 | 15 | 420 | Δ | Δ | ○ |
| 115 | — | 30 | 70 | 85 | 15 | 410 | Δ | Δ | ○ |
| 116 | — | 10 | 90 | 100 | 0 | 405 | Δ | Δ | Δ |
| 117 | — | 10 | 90 | 65 | 35 | 410 | Δ | Δ | ○ |

The electrode was examined for degradation with time by continuing the lifetime test for 1,000 hours, interrupting the test, measuring the oxygen overvoltage at the lapse of 1,000 hours in accordance with the above-mentioned oxygen overvoltage measuring method, and determining the difference between the initial and final overvoltage measurements. The oxygen overvoltage was evaluated satisfactory (○) when the overvoltage increase was less than 0.3 volts, fair (Δ) when the overvoltage increase was 0.3 to 0.7 volts, and rejected (×) when the overvoltage increase was more than 0.7 volts.

EXAMPLE 2

In accordance with Example 1, electrodes having first, second and third layers coated in this order were prepared as shown in Table 2. In inventive sample Nos. 201 to 205, the first layer had a platinum loading of 0.3 to 0.7 mg/cm$^2$, the second layer had an iridium loading of 1.2 to 1.6 mg/cm$^2$, and the third layer had an iridium loading of 0.3 to 0.7 mg/cm$^2$. In the comparative samples, the corresponding layers had equivalent or nearly equivalent loadings.

The same tests as in Example 1 were carried out. The results are shown in Table 2.

TABLE 2

| | First Layer | | | Second Layer | | Third Layer | | Oxygen | Change with time | | Mechanical bond |
|---|---|---|---|---|---|---|---|---|---|---|---|
| | Iridium Oxide (mol %) | Platinum (mol %) | Tantalum Oxide (mol %) | Iridium Oxide (mol %) | Tantalum Oxide (mol %) | Iridium Oxide (mol %) | Tantalum Oxide (mol %) | over-voltage (mV) | of oxygen over-voltage | Life time | strength (Ultrasonic weight loss) |
| Example | | | | | | | | | | | |
| 201 | — | 10 | 90 | 80 | 20 | 60 | 40 | 380 | ○ | ○ | ○ |
| 202 | — | 15 | 85 | 90 | 10 | 60 | 40 | 385 | ○ | ○ | ○ |
| 203 | — | 5 | 95 | 85 | 15 | 70 | 30 | 385 | ○ | ○ | ○ |
| 204 | — | 10 | 90 | 90 | 10 | 70 | 30 | 390 | ○ | ○ | ○ |
| 205 | — | 15 | 85 | 95 | 5 | 70 | 30 | 390 | ○ | ○ | ○ |
| Comparative Example | | | | | | | | | | | |
| 206 | 70 | — | 30 | — | — | — | — | 410 | Δ | Δ | Δ |
| 207 | 30 | — | 70 | 70 | 30 | — | — | 430 | Δ | Δ | ○ |
| 208 | 60 | 10 | 30 | 30 | 70 | — | — | 420 | Δ | Δ | ○ |

TABLE 2-continued

| | First Layer | | | Second Layer | | Third Layer | | Oxygen | Change with time | | Mechanical bond |
|---|---|---|---|---|---|---|---|---|---|---|---|
| | Iridium Oxide (mol %) | Platinum (mol %) | Tantalum Oxide (mol %) | Iridium Oxide (mol %) | Tantalum Oxide (mol %) | Iridium Oxide (mol %) | Tantalum Oxide (mol %) | over-voltage (mV) | of oxygen over-voltage | Life time | strength (Ultrasonic weight loss) |
| 209 | 100 | — | — | 70 | 30 | 60 | 40 | 430 | Δ | Δ | ○ |

EXAMPLE 3

In accordance with Example 2, coating layers were formed in a pattern as shown in Table 3. The platinum loading of coating layer A was 0.3 to 0.7 mg/cm$^2$ in inventive sample Nos. 301-307 and 0.8 to 1.2 mg/cm$^2$ in comparative sample No. 308. The iridium loading of coating layer B was 1.2 to 1.6 mg/cm$^2$ in inventive sample Nos. 301-307 and 0.7 to 1.1 mg/cm$^2$ in comparative sample No. 308. The iridium loading of coating layer C was 0.5 to 0.9 mg/cm$^2$ in inventive sample Nos. 301-302, 0.6 to 1.0 mg/cm$^2$ in inventive sample Nos. 303-307 and 1.0 to 1.4 mg/cm$^2$ in comparative sample No. 308.

The same tests as in Example 1 were carried out. The results are shown in Table 3.

lum oxide while some comparative samples had a first layer of iridium oxide alone and comparative sample No. 411 contained platinum in addition to iridium and tantalum oxides. The first layers had an iridium loading of 0.3 to 0.7 mg/cm$^2$.

Some electrode samples had the first layer as the only coating layer (the second layer was omitted) and in this case, the first layer had an iridium loading of 1.8 to 2.3 mg/cm$^2$.

To the first layer, the second layer-coating solution was brush coated, dried and then baked by placing the structure in an electric oven where it was heated at 500° C. in an air stream. The coating, drying and baking procedure was repeated several times until the predetermined metal loading was reached. There were formed the second layers consisting of iridium oxide and tanta-

TABLE 3

| | Coating Layer A | | Coating Layer B | | Coating Layer C | | Coating Pattern and number of coatings of coating layers A, B and C | | | | | | | Oxygen | Change with time of oxygen | | Mechanical bond strength (Ultrasonic |
|---|---|---|---|---|---|---|---|---|---|---|---|---|---|---|---|---|---|
| | Platinum (mol %) | Tantalum Oxide (mol %) | Iridium Oxide (mol %) | Tantalum Oxide (mol %) | Iridium Oxide (mol %) | Tantalum Oxide (mol %) | A | B | C | B | C | B | C | over-voltage (mV) | over-voltage | Life time | weight loss) |
| Example | | | | | | | | | | | | | | | | | |
| 301 | 15 | 85 | 85 | 15 | 65 | 35 | 5 | 10 | 5 | | | | | 380 | ○ | ○ | ○ |
| 302 | 15 | 85 | 85 | 15 | 65 | 35 | 5 | 5 | 3 | 5 | 2 | | | 385 | ○ | ○ | ○ |
| 303 | 15 | 85 | 85 | 15 | 65 | 35 | 5 | 4 | 3 | 3 | 2 | 2 | 1 | 395 | ○ | ○ | ○ |
| 304 | 15 | 85 | 85 | 15 | 65 | 35 | 4 | 5 | 3 | 5 | 3 | | | 390 | ○ | ○ | ○ |
| 305 | 10 | 90 | 90 | 10 | 70 | 30 | 5 | 7 | 3 | 3 | 2 | | | 395 | ○ | ○ | ○ |
| 306 | 10 | 90 | 90 | 10 | 70 | 30 | 4 | 5 | 3 | 5 | 3 | | | 390 | ○ | ○ | ○ |
| 307 | 5 | 95 | 90 | 10 | 70 | 30 | 5 | 5 | 3 | 5 | 2 | | | 385 | ○ | ○ | ○ |
| Comparative Example | | | | | | | | | | | | | | | | | |
| 308 | 50 | 50 | 30 | 70 | 60 | 40 | 5 | 5 | 4 | 3 | 3 | 3 | 3 | 430 | Δ | Δ | ○ |

Examples 4 to 6 are illustrative of the first embodiment.

EXAMPLE 4

There were formed stacking layers consisting of iridium oxide and tantalum oxide, or metallic platinum, iridium oxide and tantalum oxide in a compositional ratio as shown in Table 4. More particularly, first or second layer-coating solutions having varying compositional ratios of iridium/tantalum or iridium/platinum/tantalum were prepared by dissolving chloroplatinic acid ($H_2PtCl_6.6H_2O$), tantalum ethoxide ($Ta(OC_2H_5)_5$) and chloroiridic acid ($H_2IrCl_6.6H_2O$) in butanol in a concentration of 80 g/liter of metals.

To a titanium substrate which was previously etched with hot oxalic acid, the first layer-coating solution was brush coated, dried and then baked by placing the structure in an electric oven where it was heated at 500° C. in an air stream. The coating, drying and baking procedure was repeated several times until the predetermined metal loading was reached. In this way, there were formed first layers consisting of iridium oxide and tantalum oxide. The second layers had an iridium loading of 1.3 to 1.7 mg/cm$^2$. The electrode samples were completed in this way.

Each of the electrodes was measured for oxygen overvoltage in accordance with a potential scanning method by immersing the electrode in a 1 mol/liter sulfuric acid aqueous solution at 30° C. and conducting electricity at a current density of 20 A/dm$^2$. The results are also shown in Table 1.

The lifetime of the electrode was measured in a 1 mol/liter sulfuric acid aqueous solution at 60° C. Using the electrode as an anode and a cathode of platinum, electrolysis was carried out at a current density of 200 A/dm$^2$. The lifetime is the time over which electrolysis could be continued. The electrodes were evaluated satisfactory (○) when the lifetime was longer than 2,000 hours, fair (Δ) when the lifetime was 1,000 to 2,000 hours, and rejected (×) when the lifetime as shorter than 1,000 hours.

The electrode was examined for degradation with time by continuing the lifetime test for 1,000 hours, interrupting the test, measuring the oxygen overvoltage at the lapse of 1,000 hours in accordance with the above-mentioned oxygen overvoltage measuring method, and determining the difference between the initial and final overvoltage measurements. The oxygen overvoltage was evaluated satisfactory (◯) when the overvoltage increase was less than 0.3 volts, fair (Δ) when the overvoltage increase was 0.3 to 0.7 volts, and rejected (×) when the overvoltage increase was more than 0.7 volts.

In order to demonstrate how electrodes having first and second layers according to the invention were effective, the electrodes were tested for mechanical strength during electrolysis. The test method involved continuing the lifetime test for 1,000 hours, subjecting the electrode to a ultrasonic vibratory stripping test for 5 minutes, measuring the coating thickness before and after the vibratory stripping test by fluorescent X-ray analysis, and determining a weight loss. The stripping resistance was evaluated satisfactory (◯) when the weight loss was less than 5%, fair (Δ) when the weight loss was 5 to 10%, and rejected (×) when the weight loss was more than 10%.

The results are shown in Table 4.

TABLE 4

| | Undercoat Layer | | | Overcoat Layer | | Oxygen | Change with time | | Mechanical bond |
|---|---|---|---|---|---|---|---|---|---|
| | Iridium Oxide (mol %) | Platinum (mol %) | Tantalum Oxide (mol %) | Iridium Oxide (mol %) | Tantalum Oxide (mol %) | over-voltage (mV) | of oxygen over-voltage | Life time | strength (Ultrasonic weight loss) |
| Example | | | | | | | | | |
| 401 | 10 | — | 90 | 85 | 15 | 385 | ◯ | ◯ | ◯ |
| 402 | 14 | — | 86 | 85 | 15 | 390 | ◯ | ◯ | ◯ |
| 403 | 8.5 | — | 91.5 | 90 | 10 | 390 | ◯ | ◯ | ◯ |
| 404 | 10 | — | 90 | 90 | 10 | 395 | ◯ | ◯ | ◯ |
| 405 | 14 | — | 86 | 90 | 10 | 390 | ◯ | ◯ | ◯ |
| Comparative Example | | | | | | | | | |
| 406 | 100 | — | — | — | — | 430 | Δ | Δ | Δ |
| 407 | 70 | — | 30 | — | — | 410 | Δ | Δ | Δ |
| 408 | 60 | — | 40 | — | — | 405 | Δ | Δ | Δ |
| 409 | 30 | — | 70 | — | — | 450 | X | X | X |
| 410 | 30 | — | 70 | 70 | 30 | 430 | Δ | Δ | ◯ |
| 411 | 60 | 10 | 30 | 30 | 70 | 430 | Δ | Δ | ◯ |
| 412 | 100 | — | — | 70 | 30 | 420 | Δ | Δ | ◯ |
| 413 | 100 | — | — | 85 | 15 | 415 | Δ | Δ | ◯ |
| 414 | 0.5 | — | 99.5 | 85 | 15 | 420 | Δ | Δ | ◯ |
| 415 | 8.2 | — | 91.8 | 85 | 15 | 400 | Δ | Δ | ◯ |
| 416 | 15.5 | — | 84.5 | 85 | 15 | 400 | Δ | Δ | ◯ |
| 417 | 30 | — | 70 | 85 | 15 | 410 | Δ | Δ | ◯ |
| 418 | 10 | — | 90 | 100 | 0 | 405 | Δ | Δ | Δ |
| 419 | 10 | — | 90 | 75 | 25 | 410 | Δ | Δ | ◯ |
| 420 | 10 | — | 90 | 65 | 35 | 415 | Δ | Δ | ◯ |

EXAMPLE 5

In accordance with Example 4, electrodes having first, second and third layers coated in this order were prepared as shown in Table 5. In inventive sample Nos. 501 to 505, the first layer had an iridium loading of 0.3 to 0.7 mg/cm$^2$, the second layer had an iridium loading of 1.3 to 1.7 mg/cm$^2$, and the third layer had an iridium loading of 0.3 to 0.7 mg/cm$^2$. In the comparative sample No. 506, the only coating layer had an iridium loading of 1.8 to 2.3 mg/cm$^2$.

The same tests as in Example 4 were carried out. The results are shown in Table 5.

TABLE 5

| | First Layer | | | Second Layer | | Third Layer | | Oxygen | Change with time | | Mechanical bond |
|---|---|---|---|---|---|---|---|---|---|---|---|
| | Iridium Oxide (mol %) | Platinum (mol %) | Tantalum Oxide (mol %) | Iridium Oxide (mol %) | Tantalum Oxide (mol %) | Iridium Oxide (mol %) | Tantalum Oxide (mol %) | over-voltage (mV) | of oxygen over-voltage | Life time | strength (Ultrasonic weight loss) |
| Example | | | | | | | | | | | |
| 501 | 10 | — | 90 | 80 | 20 | 60 | 40 | 385 | ◯ | ◯ | ◯ |
| 502 | 14 | — | 86 | 90 | 10 | 60 | 40 | 390 | ◯ | ◯ | ◯ |
| 503 | 8.5 | — | 91.5 | 85 | 15 | 70 | 30 | 385 | ◯ | ◯ | ◯ |
| 504 | 10 | — | 90 | 90 | 10 | 70 | 30 | 390 | ◯ | ◯ | ◯ |
| 505 | 14 | — | 86 | 95 | 5 | 70 | 30 | 390 | ◯ | ◯ | ◯ |
| Comparative Example | | | | | | | | | | | |
| 506 | 70 | — | 30 | — | — | — | — | 410 | Δ | Δ | Δ |
| 507 | 30 | — | 70 | 70 | 30 | — | — | 430 | Δ | Δ | ◯ |
| 508 | 60 | 10 | 30 | 30 | 70 | — | — | 420 | Δ | Δ | ◯ |
| 509 | 100 | — | — | 70 | 30 | 60 | 40 | 430 | Δ | Δ | ◯ |

EXAMPLE 6

In accordance with Example 5, coating layers were formed in a pattern as shown in Table 6. The iridium loading of coating layer A was 0.3 to 0.7 mg/cm$^2$ in inventive sample Nos. 601–607 and 0.8 to 1.2 mg/cm$^2$ in comparative sample No. 608. The iridium loading of coating layer B was 1.2 to 1.6 mg/cm² in inventive sample Nos. 601-607 and 0.7 to 1.1 mg/cm² in comparative sample No. 608. The iridium loading of coating layer C was 0.5 to 0.9 mg/cm² in inventive sample Nos. 601-602, 0.6 to 1.0 mg/cm² in inventive sample Nos. 603-607 and 1.0 to 1.4 mg/cm² in comparative sample No. 608.

The same tests as in Example 4 were carried out. The results are shown in Table 6.

TABLE 3

| | Coating Layer A | | Coating Layer B | | Coating Layer C | | Coating Pattern and number of coatings of coating layers A, B and C | | | | | | | | | | |
|---|---|---|---|---|---|---|---|---|---|---|---|---|---|---|---|---|---|
| | Iridium Oxide (mol %) | Tantalum Oxide (mol %) | Iridium Oxide (mol %) | Tantalum Oxide (mol %) | Iridium Oxide (mol %) | Tantalum Oxide (mol %) | A | B | C | B | C | B | C | Oxygen overvoltage (mV) | Change with time of oxygen overvoltage | Life time | Mechanical bond strength (Ultrasonic weight loss) |
| Example | | | | | | | | | | | | | | | | | |
| 601 | 14 | 86 | 85 | 15 | 65 | 35 | 5 | 10 | 5 | | | | | 385 | ○ | ○ | ○ |
| 602 | 14 | 86 | 85 | 15 | 65 | 35 | 5 | 5 | 3 | 5 | 2 | | | 385 | ○ | ○ | ○ |
| 603 | 14 | 86 | 85 | 15 | 65 | 35 | 5 | 4 | 3 | 3 | 2 | 2 | 1 | 390 | ○ | ○ | ○ |
| 604 | 14 | 86 | 85 | 15 | 65 | 35 | 5 | 5 | 3 | 5 | 3 | | | 390 | ○ | ○ | ○ |
| 605 | 10 | 90 | 90 | 10 | 70 | 30 | 5 | 7 | 3 | 3 | 2 | | | 380 | ○ | ○ | ○ |
| 606 | 10 | 90 | 90 | 10 | 70 | 30 | 4 | 5 | 3 | 5 | 3 | | | 380 | ○ | ○ | ○ |
| 607 | 8.5 | 91.5 | 90 | 10 | 70 | 30 | 5 | 5 | 3 | 5 | 2 | | | 385 | ○ | ○ | ○ |
| Comparative Example | | | | | | | | | | | | | | | | | |
| 608 | 50 | 50 | 30 | 70 | 60 | 40 | 5 | 5 | 4 | 3 | 3 | 3 | 3 | 425 | Δ | Δ | ○ |

As is evident from the examples, the electrodes according to the first and second embodiments of the invention have a low oxygen overvoltage, a minimal change of oxygen overvoltage with time, increased mechanical bond strength and a long lifetime.

The electrode of the invention, when used as an anode in electrolysis with concomitant oxygen generation, can be used for an extended period of operation at a low bath voltage. It is also adapted for electrolysis at a high current density of more than 100 A/cm² since it is durable, maintains mechanical strength and has a long effective life. It experiences a minimal change of oxygen overvoltage with time. Therefore it is a useful oxygen generating electrode.

Although some preferred embodiments have been described, many modifications and variations may be made thereto in the light of the above teachings. It is therefore to be understood that within the scope of the appended claims, the invention may be practiced otherwise than as specifically described.

We claim:

1. An oxygen generating electrode comprising a conductive substrate, a first layer on the substrate of metallic platinum and tantalum oxide containing 80 to 99 mol% of tantalum and 20 to 1 mol% of platinum calculated as metals, and a second layer on the first layer of iridium oxide and tantalum oxide containing 80 to 99.9 mol% of iridium and 20 to 0.1 mol% of tantalum calculated as metals.

2. The oxygen generating electrode of claim 1 further comprising a third layer on the second layer of iridium oxide and tantalum oxide containing 40 to 79.9 mol% of iridium and 60 to 20.1 mol% of tantalum calculated as metals.

3. The oxygen generating electrode of claim 1 wherein more than one unit consisting of the second and third layers being repeatedly stacked on the substrate.

4. The electrode of claim 1 which is prepared by a method comprising the steps of:

applying a solution containing a platinum compound and a tantalum compound to the substrate and heat treating the coating in an oxidizing atmosphere for forming the first layer of metallic platinum and tantalum oxide containing 80 to 99 mol% of tantalum and 20 to 1 mol% of platinum calculated as metals, and applying a solution containing an iridium compound and a tantalum compound thereto and heat treating the coating in an oxidizing atmosphere for forming the second layer of iridium oxide and tantalum oxide containing 80 to 99.9 mol% of iridium and 20 to 0.1 mol% of tantalum calculated as metals.

5. The electrode of claim 2 which is prepared by a method comprising the steps of:

applying a solution containing a platinum compound and a tantalum compound to the substrate and heat treating the coating in an oxidizing atmosphere for forming the first layer of metallic platinum and tantalum oxide containing 80 to 99 mol% of tantalum and 20 to 1 mol% of platinum calculated as metals, applying a solution containing an iridium compound and a tantalum compound thereto and heat treating the coating in an oxidizing atmosphere for forming the second layer of iridium oxide and tantalum oxide containing 80 to 99.9 mol% of iridium and 20 to 0.1 mol% of tantalum calculated as metals, and applying a solution containing an iridium compound and a tantalum compound thereto and heat treating the coating in an oxidizing atmosphere for forming the third layer of iridium oxide and tantalum oxide containing 40 to 79.9 mol% of iridium and 60 to 20.1 mol% of tantalum calculated as metals.

6. The electrode of claim 3 which is prepared by a method comprising the steps of:

applying a solution containing a platinum compound and a tantalum compound to the substrate and heat treating the coating in an oxidizing atmosphere for forming the first layer of metallic platinum and tantalum oxide containing 80 to 99 mol% of tantalum and 20 to 1 mol% of platinum calculated as metals, applying a solution containing an iridium compound and a tantalum compound thereto and heat treating the coating in an oxidizing atmosphere for forming the second layer of iridium oxide and tantalum oxide containing 80 to 99.9 mol% of iridium and 20 to 0.1 mol% of tantalum calculated as metals, and applying a solution containing an iridium compound and a tantalum compound thereto and heat treating the coating in an oxidizing atmosphere for forming the third layer of iridium oxide and tantalum oxide containing 40 to 79.9 mol% of iridium and 60 to 20.1 mol% of tantalum calculated as metals, and repeating the steps of forming the second and third layers for alternately stacking the second and third layers.

7. An oxygen generating electrode comprising a conductive substrate, a first layer on the substrate of iridium oxide and tantalum oxide containing 14 to 8.4 mol% of iridium and 86 to 91.6 mol% of tantalum calculated as metals, and a second layer on the first layer of iridium oxide and tantalum oxide containing 80 to 99.9 mol% of iridium and 20 to 0.1 mol% of tantalum calculated as metals.

8. The oxygen generating electrode of claim 7 further comprising a third layer on the second layer of iridium oxide and tantalum oxide containing 40 to 79.9 mol% of iridium and 60 to 20.1 mol% of tantalum calculated as metals.

9. The oxygen generating electrode of claim 7 wherein more than one unit consisting of the second and third layers being repeatedly stacked on the substrate.

10. The electrode of claim 7 which is prepared by a method comprising the steps of:

applying a solution containing an iridium compound and a tantalum compound to the substrate and heat treating the coating in an oxidizing atmosphere for forming the first layer of iridium oxide and tantalum oxide containing 14 to 8.4 mol% of iridium and 86 to 91.6 mol% of tantalum calculated as metals, and applying a solution containing an iridium compound and a tantalum compound thereto and heat treating the coating in an oxidizing atmosphere for forming the second layer of iridium oxide and tantalum oxide containing 80 to 99.9 mol% of iridium and 20 to 0.1 mol% of tantalum calculated as metals.

11. The electrode of claim 8 which is prepared by a method comprising the steps of:

applying a solution containing an iridium compound and a tantalum compound to the substrate and heat treating the coating in an oxidizing atmosphere for forming the first layer of iridium oxide and tantalum oxide containing 14 to 8.4 mol% of iridium and 86 to 91.6 mol% of tantalum calculated as metals, and applying a solution containing an iridium compound and a tantalum compound thereto and heat treating the coating in an oxidizing atmosphere for forming the second layer of iridium oxide and tantalum oxide containing 80 to 99.9 mol% of iridium and 20 to 0.1 mol% of tantalum calculated as metals, and applying a solution containing an iridium compound and a tantalum compound thereto and heat treating the coating in an oxidizing atmosphere for forming the third layer of iridium oxide and tantalum oxide containing 40 to 79.9 mol% of iridium and 60 to 20.1 mol% of tantalum calculated as metals.

12. The electrode of claim 9 which is prepared by a method comprising the steps of:

applying a solution containing an iridium compound and a tantalum compound to the substrate and heat treating the coating in an oxidizing atmosphere for forming the first layer of iridium oxide and tantalum oxide containing 14 to 8.4 mol% of iridium and 86 to 91.6 mol% of tantalum calculated as metals, and applying a solution containing an iridium compound and a tantalum compound thereto and heat treating the coating in an oxidizing atmosphere for forming the second layer of iridium oxide and tantalum oxide containing 80 to 99.9 mol% of iridium and 20 to 0.1 mol% of tantalum calculated as metals, and applying a solution containing an iridium compound and a tantalum compound thereto and heat treating the coating in an oxidizing atmosphere for forming the third layer of iridium oxide and tantalum oxide containing 40 to 79.9 mol% of iridium and 60 to 20.1 mol% of tantalum calculated as metals, and repeating the steps of forming the second and third layers for alternately stacking the second and third layers.

* * * * *